United States Patent [19]

Nakahama

[11] 4,421,490

[45] Dec. 20, 1983

[54] EXHAUST SILENCER STRUCTURE FOR OUTBOARD ENGINES

[75] Inventor: Ryoji Nakahama, Iwata, Japan

[73] Assignees: Yamaha Motor Co., Ltd.; Sanshin Industries Co., Ltd., both of Japan

[21] Appl. No.: 345,716

[22] Filed: Feb. 4, 1982

[30] Foreign Application Priority Data

Feb. 23, 1981 [JP] Japan ..... 56-25282

[51] Int. Cl.[3] ..... B63H 21/26

[52] U.S. Cl. ..... 440/89; 440/88

[58] Field of Search ..... 440/89, 88

[56] References Cited

U.S. PATENT DOCUMENTS

| | | | |
|---|---|---|---|
| 3,310,022 | 3/1967 | Kollman | 440/89 |
| 3,350,879 | 11/1967 | Boda et al. | 60/31 |
| 3,520,270 | 7/1970 | Miller | 440/89 |
| 4,354,849 | 10/1982 | Sanmi et al. | 440/89 |

*Primary Examiner*—S. D. Basinger
*Assistant Examiner*—Ivy M. Shum
*Attorney, Agent, or Firm*—Ernest A. Beutler

[57] ABSTRACT

An exhaust system for an outboard engine that improves exhaust efficiency and silencing at low speeds. The low speed exhaust gases are delivered to the atmosphere through a predetermined water level that is maintained in a separate water reservoir.

7 Claims, 4 Drawing Figures

EXHAUST SILENCER STRUCTURE FOR OUTBOARD ENGINES

BACKGROUND OF THE INVENTION

This invention relates to an exhaust silencer structure for outboard engines and more particularly to an outboard silencing arrangement that provides effective silencing throughout the entire engine speed range.

It has been known to provide a silencing structure for an outboard motor in which the exhaust gases are discharged through the lower unit of the engine. Specifically it has been proposed to discharge the exhaust gases through the propeller by constructing a hollow propeller through which the exhaust gases may be discharged. This system provides extremely good silencing and efficient exhaust under high speed running conditions. However, during slow running, the lower unit of the outboard is normally submerged to a greater extent than at high speed running. Thus, the exhaust output is discharged at a lower water level resulting in increased back pressure. It has, therefore, been proposed to improve exhaust efficiency during low speed running through the provision of a small exhaust outlet that is positioned above the water level and through which the exhaust gases may be discharged during low speed running. Of course, such an arrangement does not provide any significant silencing at low speed.

It is, therefore, a principal object of this invention to provide an exhaust system for an outboard engine that provides effective silencing throughout the engine speed range and also which provides for efficient exhaust gas discharge without substantial back pressure.

It is a further object of this invention to provide an improved low speed silencing system for an outboard engine.

SUMMARY OF THE INVENTION

This invention is adapted to be embodied in an exhaust system for an outboard engine or the like having an expansion chamber, means for delivering exhaust gases from the engine to the expansion chamber, a high speed exhaust outlet extending from the expansion chamber to a point beneath the water level in which the engine is operated and a low speed outlet communicating with the atmosphere above the water level. In accordance with the invention means form a water reservoir having an exhaust gas inlet in communication with the reservoir above the normal water level therein and an exhaust discharge at a predetermined level below the normal level that is in communication with the low speed exhaust outlet.

DETAILED DESCRIPTION OF THE PREFERRED EMBODIMENT

Figure 1:
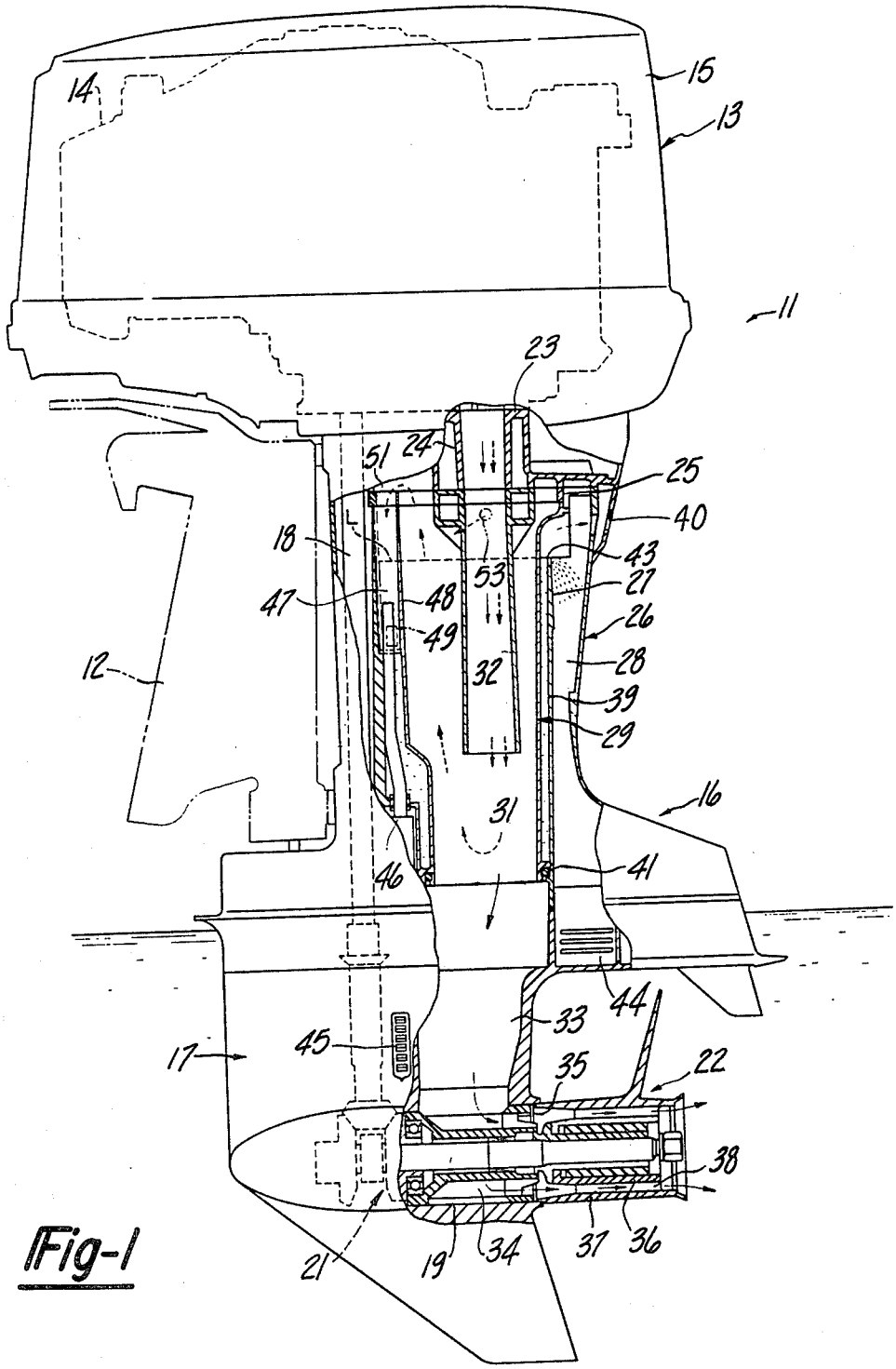
FIG. 1 is a side elevational view, with portions broken away, of an outboard motor embodying this invention.

The reference numeral 11 indicates generally an outboard motor constructed in accordance with this invention. The motor 11 includes a bracket 12 (shown in phantom) which permits the motor 11 to be affixed to the transom of the hull of a boat (not shown). Although the boat is not shown, the drawings illustrate the motor as it appears when mounted on a boat and in the water.

The motor 11 is comprised of a powerhead 13 in which an internal combustion engine 14 is contained. The engine 14 is enclosed within a protective cowling 15. The powerhead 13 is affixed to a driveshaft housing 16 which, in turn, is affixed to a lower unit 17.

The engine 14 has its crankshaft coupled to a vertically extending driveshaft 18 in a known manner. The driveshaft 18 extends through the driveshaft housing 16 and drives a propeller shaft 19 of the lower unit 17 by means of a known type of forward/reverse transmission mechanism, indicated generally at 21. A propeller, indicated generally at 22, is connected to the propeller shaft 19 in a manner to be described.

The exhaust gases from the engine 14 are delivered to an exhaust guide casting 23 which is affixed to the engine 14 in a known manner and which forms an exhaust passage 24. The exhaust passage 24 communicates with a corresponding exhaust passage of an exhaust manifold casting 25 that is interposed between the exhaust guide casting 23 and the driveshaft housing 16.

Driveshaft housing 16 is preferably a casting made from aluminum and includes an outer wall 26 and an inner wall 27. The inner and outer walls 27 and 26 are spaced apart and define a cavity 28 therebetween. A silencer, indicated generally by the reference numeral 29, is positioned within the driveshaft housing 16 inwardly of its inner wall 27. The silencer 29 is fixed, in any suitable manner, to the manifold 25 and exhaust gas guide 23. The silencer 29 forms an expansion chamber 31. An exhaust inlet pipe 32 is affixed to the exhaust manifold 25 and has an internal passage that communicates with the expansion chamber 31.

The lower unit 17 is formed with an exhaust passage 33 that communicates with the lower end of the expansion chamber 31. The exhaust passage 33, in turn, is in communication with an annular area 34 formed around the propeller shaft 19. The annular area 34 terminates at an annular opening 35 which is juxtaposed to the propeller 22. The propeller 22 is comprised of an inner sleeve 36 and an outer sleeve 37 that are connected together by ribs and which define a generally annular gap 38 therebetween. The forward end of the gap 38 is in communication with the lower unit annular passage 35 so that exhaust gases may flow from the expansion chamber 31 and be discharged through the propeller 22. This has been found to provide extremely good exhaust efficiency and further improve silencing.

Figure 4:
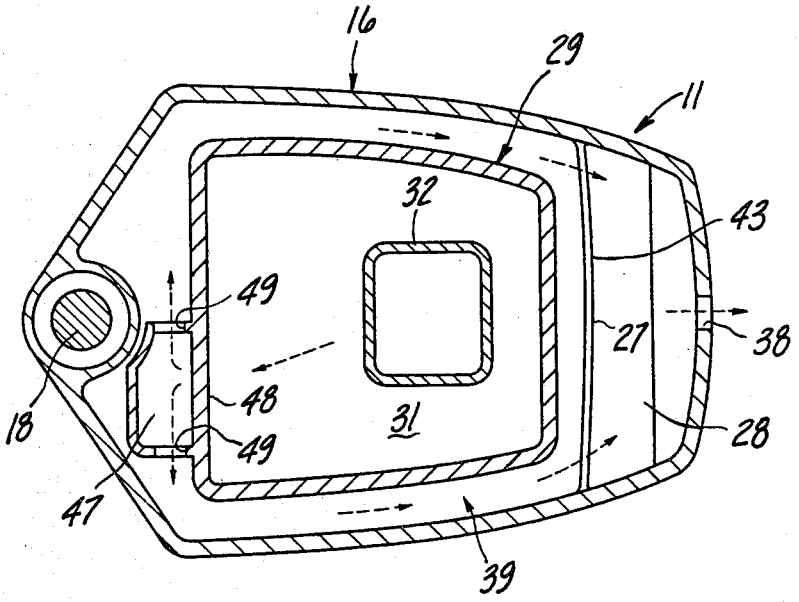
FIG. 4 is a cross-sectional view taken along the line 4—4 of FIG. 2.

Although the described propeller exhaust system provides good silencing and good exhaust efficiency under high speed running, the gap 38 of the propeller 22 is disposed at a relatively lower water level when the engine is running at low speeds than when running at high speeds. This difference in water level gives sufficient back pressure as to make the discharge of exhaust gases through the gap 38 at low speeds either difficult or inefficient. That is, there is too greater a back pressure so as to permit efficient exhaust under this running condition. Therefore, it has been proposed to provide a low speed atmospheric exhaust port 40 (FIGS. 1, 2 and 4) in the driveshaft housing 16 at a level considerably above the water level. In accordance with the prior art type of constructions, the low speed exhaust port 40 is in direct communication with the expansion chamber 31 and, therefore, there is little or no silencing at low speeds. In accordance with this invention, an arrangement is provided wherein there will be effective silencing even at low speeds without introducing high back pressures.

Figure 2:
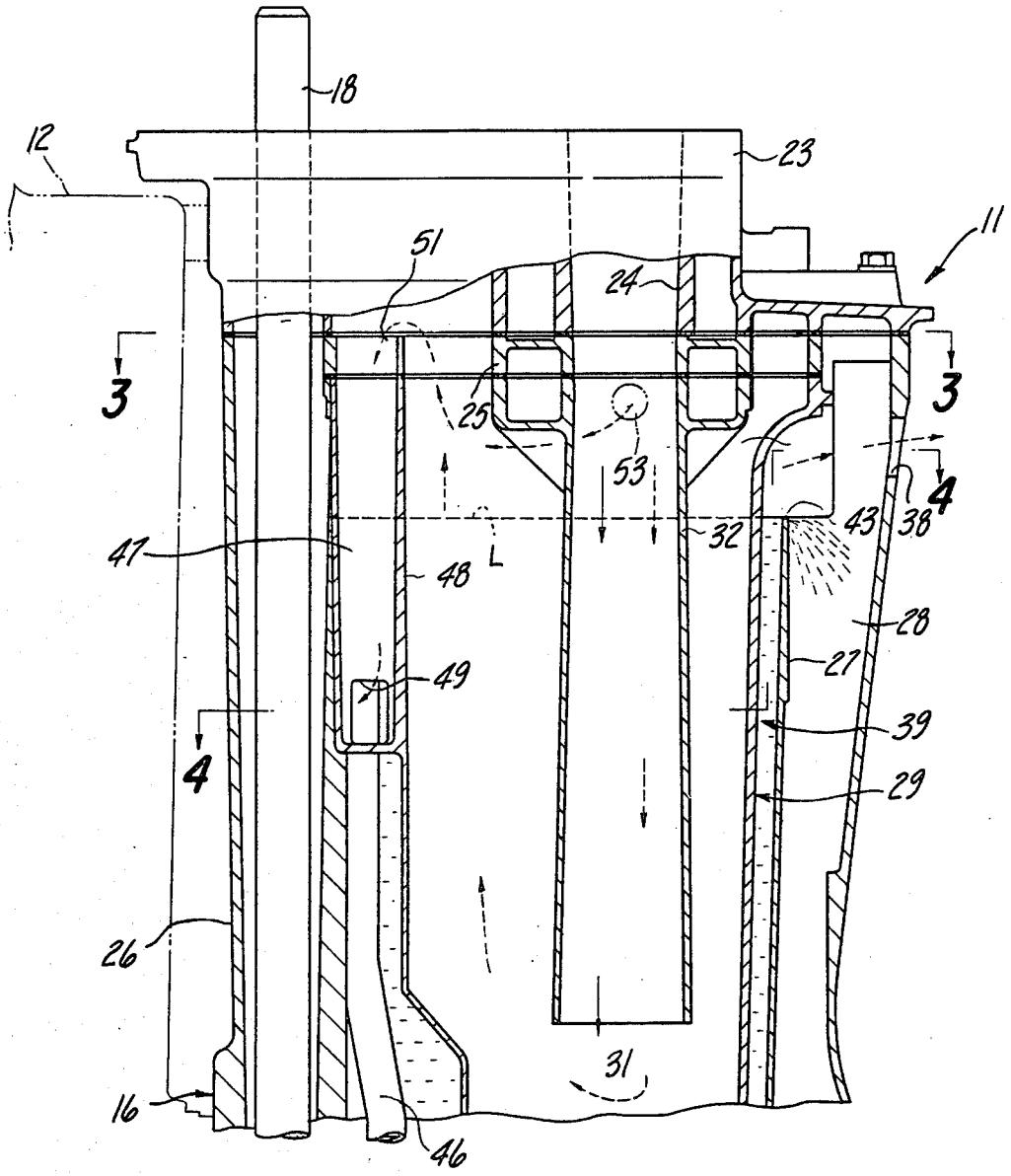
FIG. 2 is an enlarged cross-sectional view of the motor showing a portion of the exhaust system.
Figure 3:
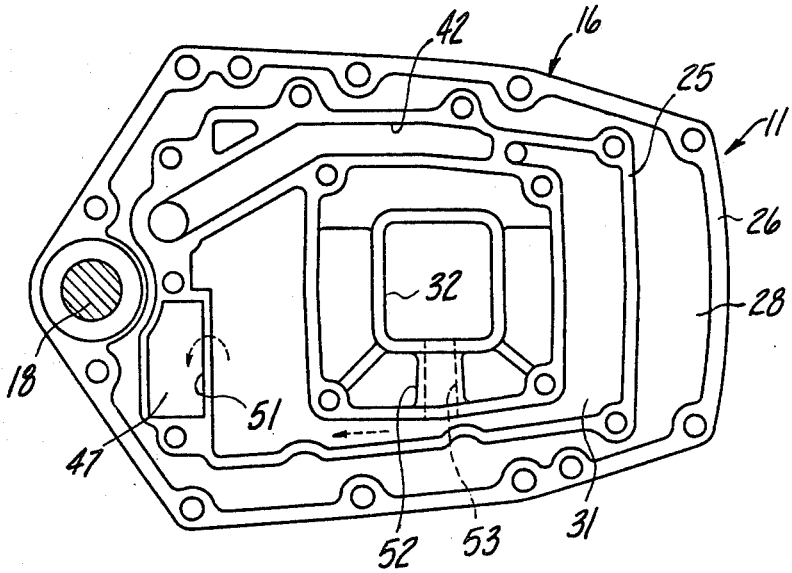
FIG. 3 is a cross-sectional view taken along the line 3—3 of FIG. 2.

To this end, an arrangement is provided whereby at low speeds the exhaust gases are delivered to the low speed port 40 through a fixed head of water. A water reservoir, indicated generally by the reference numeral 39, is provided between the outer periphery of the silencer 29 and the inner periphery of the driveshaft housing inner wall 27. A seal or gasket 41 is provided at the lower periphery of the reservoir 39. Engine coolant is delivered to the reservoir 39 through a passage 42 (FIG. 3) which is in communication with the coolant discharge of the engine 14. The coolant level is maintained at a predetermined level indicated by the line L by means of a weir 43 that is formed in the driveshaft housing inner wall 27 in communication with the cavity 28. The lower end of the cavity 28 communicates with the water in which the motor 11 is operating by means of a plurality of discharge slots 44 that are formed in the lower portion of the driveshaft housing 16 (FIG. 1). Coolant for the engine 14 is drawn from the body of water in which the outboard motor 11 is operating by means of coolant inlets 45 formed in the lower unit 17. The coolant is delivered from a coolant pump (not shown) through a coolant delivery tube 46 to the cooling system of the engine 14 in any known manner.

A vertically extending exhaust inlet passage 47 is formed in the silencer 29 by means of a vertically upstanding wall 48. The lower end of the exhaust inlet passage 47 communicates with the water in the reservoir 39 at a fixed point below the level L through one or more transversely extending passages 49 extend through the wall 48. The upper end of the exhaust inlet 47 registers with an exhaust manifold inlet passage 51 that is formed in the exhaust manifold 25. The inlet 51 communicates with the upper portion of the expansion chamber 31. A wall 52 (FIG. 3) of the silencer 29 that connects its outermost portion with the exhaust inlet portion 32 is formed with an exhaust passage 53 that communicates with the expansion chamber 31 adjacent its uppermost end.

In operation, when the outboard motor 11 is running, coolant will be drawn through the coolant inlet 45 and delivered by the pump to the cooling jacket of the engine 14 through the pipe 46. The collant will be discharged through the passage 42 into the reservoir 39. When the level established by the weir 43 is reached (L) the coolant will flow over the weir 43 and be discharged through the cavity 28 and coolant outlets 44.

When the boat and associated motor 11 are travelling at a high speed, the propeller outlet cavity 38 will be disposed fairly closely to the water level and there will be insufficient back pressure so as to resist discharge of the exhaust gases from the expansion chamber 31 through the propeller outlet 38. When the engine 11 and boat are travelling at low speeds, however, the propeller outlet 38 will be disposed at a lower level below the level of the water in which the boat is operating and there will be sufficient back pressure to resist the discharge of exhaust gases through the propeller outlet 38. Under this condition, the exhaust gases will flow from the upper portion of the expansion chamber 31 through the manifold inlet 51 to the exhaust passage 47 that communicates through the passages 49 with the water in the reservoir 39. The exhaust gases will flow through the water in the reservoir 39 and be discharged through an area 54 formed about the weir 43 at the upper end of the cavity 28. These exhaust gases can then be discharged to the atmosphere through the slow speed exhaust port 40. The gases, however, will have been silenced by the expansion chamber 31 and the fact that they were forced to flow through a predetermined level of water.

It should be readily apparent that an arrangement has been disclosed wherein effective silencing with exhaust back pressure control throughout the engine speed range. Although the invention has been described in conjunction with an engine having a propeller exhaust gas outlet, it is to be understood that it may be used with engines having other conventional high speed exhaust outlets through the lower unit 17. Furthermore, various other changes and modifications may be made without departing from the spirit and scope of the invention, as defined by the appended claims.

What is claimed is:

1. In an exhaust system for an outboard engine or the like having an expansion chamber, means for delivering exhaust gases from the engine to said expansion chamber, a high speed exhaust outlet extending from said expansion chamber to a point beneath the water level in which said engine is operated, and a low speed exhaust outlet comunicating with the atmosphere above the water level, the improvement comprising means forming a water reservoir having an exhaust gas inlet in communication with said reservoir above normal water level therein and an exhaust discharge at a predetermined level below said normal level and providing the only communication of said exhaust gas inlet with said low speed exhaust outlet for effecting low speed discharge of exhaust gases only through the water level in the water reservoir.

2. An exhaust system as set forth in claim 1 wherein the reservoir is filled with engine coolant.

3. An exhaust system as set forth in claim 2 wherein the water level is maintained in the reservoir by delivering engine coolant thereto and discharging engine coolant therefrom through a weir at a fixed height.

4. An exhaust system as set forth in claim 3 wherein the water reservoir surrounds the expansion chamber.

5. An exhaust system as set forth in claim 4 wherein the low speed exhaust outlet is formed in registry with one side of the upper portion of the reservoir, the exhaust gas inlet and the exhaust discharge of the water reservoir being formed at the other side thereof.

6. An exhaust system as set forth in claim 5 wherein there is an exhaust inlet in communication with the central portion of the expansion chamber and further including a low speed exhaust inlet extending to the upper portion of the expansion chamber.

7. An exhaust system as set forth in claim 1 wherein there is an exhaust inlet in communication with the central portion of the expansion chamber and further including a low speed exhaust inlet extending to the upper portion of the expansion chamber.

* * * * *